US006434986B1

(12) United States Patent
Rice et al.

(10) Patent No.: US 6,434,986 B1
(45) Date of Patent: Aug. 20, 2002

(54) LOCK PROTECTION

(75) Inventors: William Rice; Stan Dunbar, both of Dundee (GB)

(73) Assignee: NCR Corporation, Dayton, OH (US)

( * ) Notice: Subject to any disclaimer, the term of this patent is extended or adjusted under 35 U.S.C. 154(b) by 0 days.

(21) Appl. No.: 09/551,755

(22) Filed: Apr. 18, 2000

(30) Foreign Application Priority Data

Apr. 24, 1999 (GB) ..... 9909404

(51) Int. Cl.[7] ..... E05B 15/16
(52) U.S. Cl. ..... 70/333 R; 70/417
(58) Field of Search ..... 70/333 R, 416, 70/417

(56) References Cited

U.S. PATENT DOCUMENTS

| | | | | | |
|---|---|---|---|---|---|
| 3,083,563 | A | | 4/1963 | Greenwald | 70/417 |
| 3,550,411 | A | * | 12/1970 | Neary et al. | 70/417 |
| 4,338,804 | A | * | 7/1982 | Solovieff | 70/417 X |
| 4,342,207 | A | | 8/1982 | Holmes et al. | 70/119 |
| 4,509,350 | A | * | 4/1985 | Gartner | 70/417 X |
| 4,628,715 | A | * | 12/1986 | Uyeda et al. | 70/417 X |
| 5,216,910 | A | | 6/1993 | Lin | 70/370 |
| 5,257,517 | A | * | 11/1993 | Dale | 70/417 X |
| 5,305,695 | A | * | 4/1994 | Lichter | 70/417 X |
| 5,906,125 | A | * | 5/1999 | Shen | 70/417 X |
| 6,240,754 | B1 | * | 6/2001 | Petersen | 70/417 |

FOREIGN PATENT DOCUMENTS

| | | | | |
|---|---|---|---|---|
| AU | 526432 | | 1/1983 | |
| DE | 442553 | * | 5/1924 | 70/417 |
| DE | 2557151 | * | 7/1976 | 70/417 |
| DE | 2754372 | * | 6/1979 | 70/417 |
| EP | 392378 | * | 10/1990 | 70/417 |
| GB | 1451046 | | 9/1976 | |
| GB | 2111583 | | 7/1983 | |

* cited by examiner

*Primary Examiner*—Suzanne Dino Barrett
(74) *Attorney, Agent, or Firm*—Francis L. Conte

(57) ABSTRACT

A secure container comprises an external wall including a door (56) and a lock (36) for securing the door (56). The lock (36) comprises a lock mechanism (47) located internally of the wall (56) and a plate (40) mounted between the wall (56) and the lock mechanism (47). The plate (40) is tiltable in response to applied pressure.

13 Claims, 2 Drawing Sheets

LOCK PROTECTION

BACKGROUND OF THE INVENTION

The present invention relates to a method and apparatus for the protection of locks against forcible entry. The invention has particular application in the protection of security locks as found on, for example, safes against attack by drilling.

It is obviously important that locks and in particular lock mechanisms be protected against unauthorized access; such access attempts are often made by force. One field where locks must be secure against such attacks is in the area of self-service terminals (SSTs) used to deposit or dispense valuable media, particularly financial services centers (FSCs) and automated teller machines (ATMs); FSCs and ATMs are nearly always accessible to the public, and are known to contain large amounts of cash.

A conventional ATM contains a safe in which the banknotes to be dispensed by the ATM are stored. Access to the safe is gained through a door provided with a conventional safe lock, typically a combination lock. The lock mechanism is mounted on the inner face of the safe door and controls the release of a locking bar or bolt which secures the door.

At present, the lock is protected by the provision of what is known as a hard plate; that is, a plate of fully hardened steel mounted in an enclosure between the safe door and the lock mechanism. To open the safe door forcibly without damaging the valuable media within the safe it is necessary to drill through the safe door and the hard plate, typically at a number of locations, to gain access to the lock mechanism, which is then forced to release the locking bar or bolt. A conventional hard plate and a lock fitted with such a hard plate are shown in FIGS. 1 and 2 of the accompanying drawings.

Existing hard plates are capable of withstanding a drilling attack from carbide tipped drills for at least 10 minutes. However, drilling technology is constantly improving and recently developed solid carbide drills, although very brittle, are able to penetrate existing hard plates in a relatively short period.

A further problem with existing hard plates that has been identified by the applicants is that, once a hard plate is freed from its support on the lock spindle, which may be achieved by hammering the spindle into the safe, the hard plate may be pushed to the rear of the hard plate enclosure by the pressure of a drill. The plate comes to rest adjacent the internal lock mechanism, which provides a secure substrate for the drilling operation, and thus facilitates breach of the lock.

Provision of ever-harder and more drill-resistant hard plates is technically feasible. However, the cost of such materials would add disproportionally to the manufacturing costs of an ATM, the safe already being one of the most expensive single elements of a typical ATM.

SUMMARY OF THE INVENTION

It is among the objects of embodiments of the present invention to alleviate or obviate these and other problems of existing lock security features.

According to the present invention there is provided a secure container comprising:

an external wall including a door; and a lock for securing the door, the lock comprising a lock mechanism located internally of the wall and a plate mounted between the wall and the lock mechanism, the plate being tiltable in response to applied pressure.

The invention also relates to a lock for fitting to such a secure container, and further to a hard plate for fitting to such a lock.

In use, the plate will tilt or move in response to applied pressure, away from the point of application. Thus, the plate will move to evade the point of a drill on the application of drilling pressure, such that the cutting point of the drill will have difficulty gaining or be unable to gain adequate purchase to begin cutting through the plate. The tilting of the plate will also result in the drill being subject to lateral forces; the hardest drills, such as solid carbide drills, are very brittle and are likely to break if an attempt is made to drill into a hard surface that is at an angle other than perpendicular to the drill axis.

Preferably, the material from which the plate is made is itself resistive to cutting by a drill, to provide additional security. Materials known in the art may be used, such as fully toughened steel. Alternatively, or additionally, the plate may be coated with a cutting resistant material.

Preferably, the plate is mounted on a pivot, conveniently at or adjacent the center of the plate. The pivot is conveniently provided by a tapered bush mounted on or around a lock spindle, which spindle extends from the internal locking mechanism to the exterior of the lock.

Preferably, the plate has a convex outer surface. Such a surface will tend to deflect a drill point and increase the likelihood of brittle drills snapping.

Preferably also, the plate is tiltable such that at least a part of the plate outer surface is at an angle of at least 31° from the plane of the adjacent container wall. Standard metal drills have a point angle of at least 118° (for drilling relatively hard metals the point angle tends to be higher), such that a drill extending through a hole drilled perpendicular to the container wall will cause the plate to tilt to an angle at which the drill point will be unable to achieve a point contact with the plate and thus will be unable to initiate the drilling of a hole in the plate.

Preferably, the plate is rotatable, most preferably through 360°. This is most conveniently achieved by mounting a circular hard plate in a corresponding circular lock housing. This construction provides an additional degree of freedom of movement for the plate, increasing the difficulty in stabilizing the plate to facilitate drilling and prevent breakage of brittle drills.

Preferably, the container is a safe, which may be incorporated in an automated teller machine (ATM).

According to a further aspect of the present invention, there is provided a method of protecting a lock mechanism provided in a secure container, the method comprising providing a tiltable plate between the lock mechanism and an external wall of the container.

According to another aspect of the present invention there is provided a secure container comprising:

an external wall including a door;

a lock for securing the door, the lock comprising a lock mechanism located internally of the wall and a plate mounted between the wall and the lock mechanism, the plate having an external surface which is inclined relative to the wall.

The plate surface may be inclined, conical, frusto-conical, concave or convex, or otherwise configured such that a drill located in a drilled hole in the container wall which is perpendicular to the wall will contact the plate surface at an angle other than 90°, and preferably at an angle such that the drill point will not contact with the plate surface, such that the drill point is unable to initiate drilling of a hole in the plate.

BRIEF DESCRIPTION OF THE DRAWINGS

These and other aspects of the present invention-will now be described by way of example only and with reference to the accompanying drawings in which.

DETAILED DESCRIPTION

Figure 1:
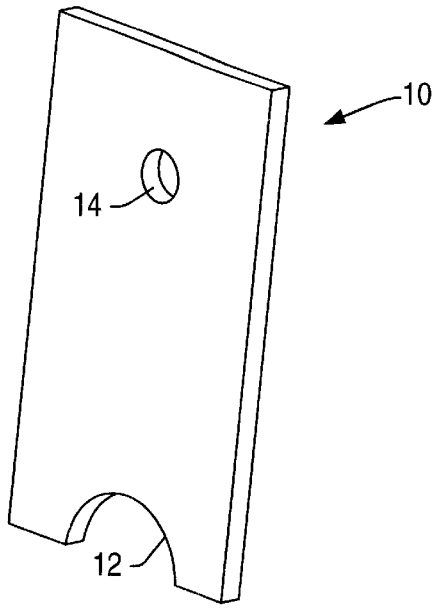
PRIOR ART FIG. 1
FIG. 1 shows a typical prior art hard plate.

Referring first to FIG. 1, this shows a typical prior art hard plate 10 for a safe door lock. The hard plate 10 comprises a generally rectangular flat plate of hardened steel. The plate 10 has a notch 12, which rests upon a bolt of the lock (not shown) in order to support the plate 10, and an aperture 14, through which passes the spindle of the lock.

Figure 2:
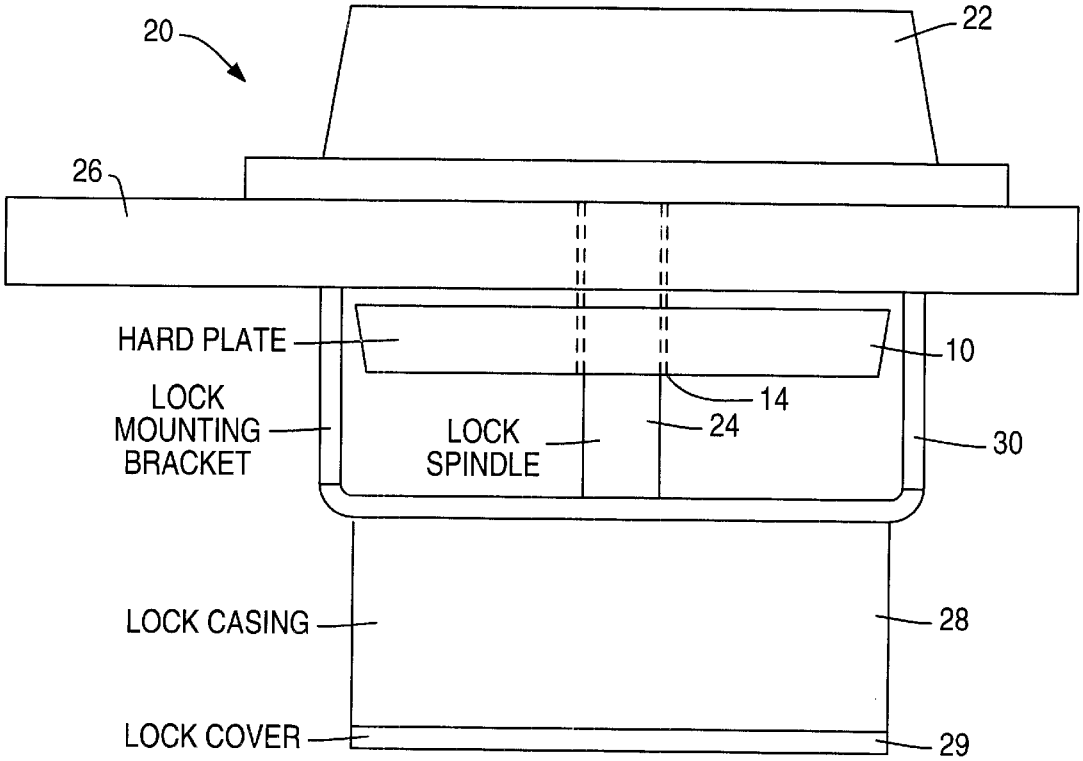
FIG. 2 PRIOR ART
FIG. 2 is a schematic cross-section of a lock fitted with the hard plate of FIG. 1.

The plate 10 is located between an outer wall of the safe, typically the safe door, and the internal locking mechanism of the lock, as illustrated in FIG. 2. The assembled lock 20 includes an exterior lock dial 22, mounted on a lock spindle 24 which passes through the safe door 26 and through the hole 14 in the hard plate 10. The spindle 24 passes into a lock casing 28 and is connected to the internal lock mechanism (not shown) contained therein. A mounting bracket 30 for the lock casing 28 provides an enclosure in which the plate 10 is mounted.

In one recognized method of attempting to gain unauthorized access to the safe, the lock dial 22 is knocked off the spindle 24, which is then hammered into the lock casing 28 such that the spindle 24 is driven into, and dislodges, the lock casing cover 29. A drilling attack then commences on the safe door 26 and the plate 10 until access has been gained to the interior of the lock casing 28. A number of holes will normally have to be drilled to gain sufficient access to the lock mechanism, and the limited space will normally require that the holes are drilled one at a time; typically, a first operator equipped with a power drill will crouch in front of the safe door, while a second operator pushes the first operator towards the door to provide a load on the drill. Once the necessary holes have been drilled, further hammer attacks on the lock mechanism inside the casing 28 may then serve to disengage the lock and allow the door 26 to be opened.

Figure 3:
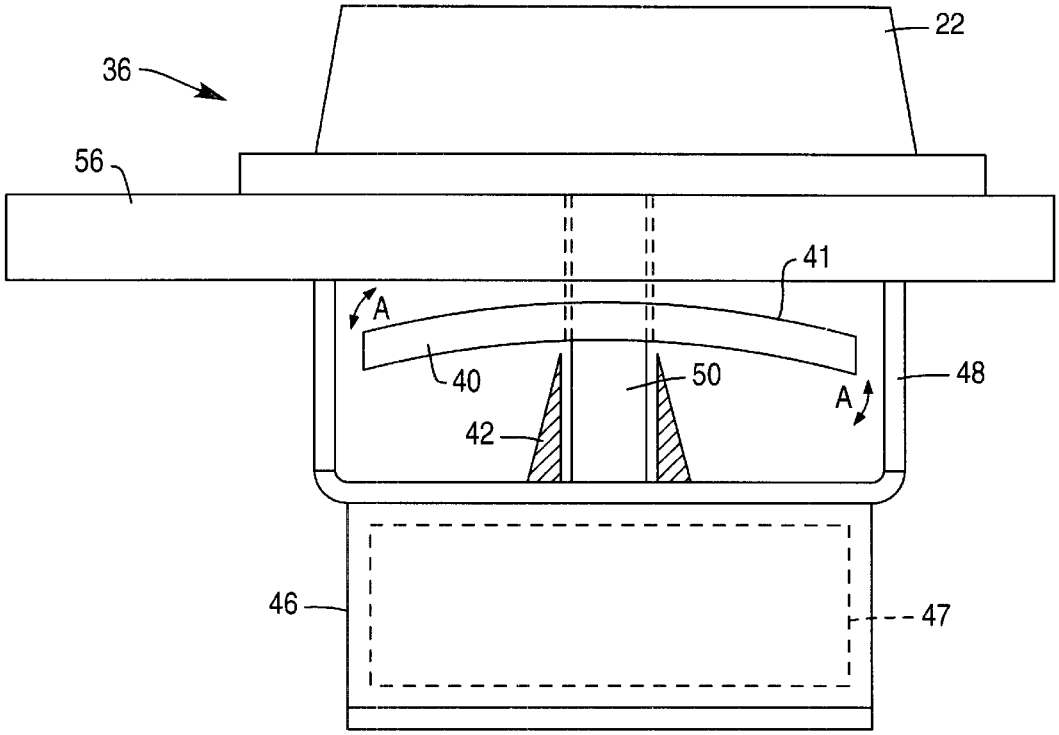
FIG. 3 is a schematic cross-section of a lock fitted with a hard plate according to an embodiment of the present invention.

Reference is now made to FIG. 3 of the drawings, which shows a lock 36 fitted with a hard plate 40 according to the present invention. The parts of the lock 36 in this Figure are generally similar to those shown in FIG. 2. However, in this instance the hard plate 40 has a convex outer surface 41. Further, the plate 40, the lock casing 46 containing the lock mechanism 47, and the lock mounting bracket 48 are circular, such that the plate 40 may rotate within the enclosure defined by the bracket 48. The plate 40 is freely mounted on the lock spindle 50, and is supported by a tapered bush 42 which surrounds the lock spindle 50. Provision of the bush 42 enables the plate 40 to pivot about the spindle 50; thus, when force is applied to a point on the plate 40, the plate will tend to pivot in the direction shown by arrows A, the bush 42 and the bracket 48 being dimensioned to permit the plate 40 to pivot to a predetermined minimum inclination, as described below. Accordingly, if a drill point comes into contact with the outer surface of the plate 40, the plate 40 will move away from the drill, which is therefore unable to gain purchase to begin cutting.

Figure 4:
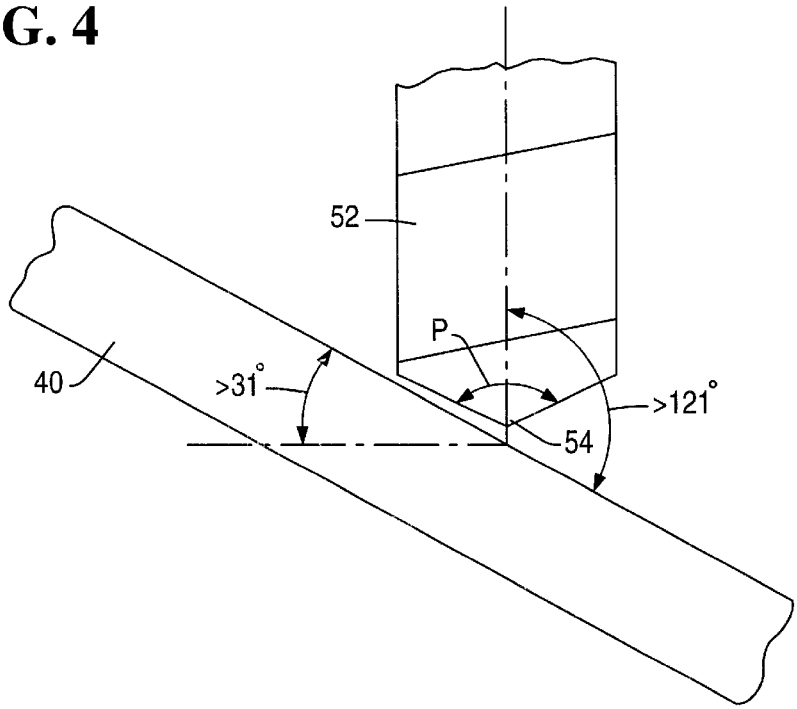
FIG. 4 shows a sketch of a drill bit contacting the hard plate of FIG. 3.

The contact between the plate 40 and a drill 52 is shown in schematic detail in FIG. 4, where the hard plate 40 is shown tilted due to the drill bit 52 pressing against the plate 50 in the course of an attempted drill attack. Due to the ability of the plate 40 to pivot to a minimum predetermined inclination on contact with a drill 52, the point 54 of the drill 52 does not contact the plate 40, as described below.

A standard metal drill has a point angle "P" of 118°, and tilting of the plate 40 such that the plate surface is at an obtuse angle of greater than 121° to the drill axis, which will generally be perpendicular to the safe door 56 (the drill will typically pass through a hole drilled in the door 56 perpendicular to the door surface), will prevent the point 52 from contacting the plate 40. Thus, the drill cannot begin cutting through the plate 40. Furthermore, solid carbide drills are very brittle, and the lateral forces induced in such a drill being pushed into the plate 40 will tend to cause the drill to snap.

Thus, it can be seen that provision of a curved, pivotable and rotatable hard plate in conjunction with a safe lock will serve to reduce the likelihood of a drill attack successfully penetrating the lock, and so increase the security of the lock.

It is to be understood that the foregoing is for illustrative purposes only, and that various modifications may be made to the apparatus described herein without departing from the scope of the invention. For example, the hard plate may be fixed, but provided with an inclined outer surface, that is the hard plate may be conical or the like.

What is claimed is:

1. A safe door comprising:

opposite external and internal wall surfaces;

a mounting bracket disposed on said internal wall surface;

a lock mechanism disposed on said mounting bracket;

a lock dial disposed on said external wall surface;

a lock spindle extending through said bracket and joining said dial to said lock mechanism;

a bush surrounding said spindle inside said bracket; and a security plate pivotally mounted on said bush around said spindle, and being tiltable under pressure from a drill bit extending through said door to restrain purchase engagement between said bit and plate.

2. A door according to claim 1 wherein said plate has a convex outer surface facing said dial.

3. A door according to claim 2 wherein said plate is tiltable inside said bracket to prevent a point of said drill bit from contacting said plate.

4. A secure container comprising:

an external wall including a door;

a lock for securing the door, the lock including a lock mechanism located internally of the wall and a plate mounted between the wall and the lock mechanism, the plate being tiltable in response to pressure from a drill bit applied substantially perpendicular to said wall to prevent the point of said drill bit from purchasing said plate; and a pivot on which the plate is mounted for tilting thereof.

5. A secure container according to claim 4, wherein the pivot is located adjacent a central area of the plate.

6. A secure container according to claim 4, wherein the pivot comprises a tapered bush mounted on a lock spindle.

7. A secure container according to claim 6, wherein the plate has a convex outer surface.

8. A secure container comprising:

an external wall including a door; and a lock for securing the door, the lock including a lock mechanism located internally of the wall and a plate mounted between the wall and the lock mechanism, the plate being tiltable in response to pressure from a drill bit applied substantially perpendicular to said wall to prevent the point of said drill bit from purchasing said plate, the plate being tiltable such that at least a part of the plate outer surface is at an angle of at least 31° from the plane of the adjacent wall.

9. An automated teller machine (ATM) comprising:

a safe including an external wall having a door;

a lock for securing the door, the lock including a lock mechanism located internally of the wall and a plate mounted between the wall and the lock mechanism, the plate being tiltable in response to pressure from a drill bit applied substantially perpendicular to said wall to prevent the point of said drill bit from purchasing said plate; and a pivot on which the plate is mounted for tilting thereof.

10. An ATM according to claim 9, wherein the pivot is located adjacent a central area of the plate.

11. An ATM according to claim 9, wherein the pivot comprises a tapered bush mounted on a lock spindle.

12. An ATM according to claim 11, wherein the plate has a convex outer surface.

13. An automated teller machine (ATM) comprising:

a safe including an external wall having a door; and a lock for securing the door, the lock including a lock mechanism located internally of the wall and a plate mounted between the wall and the lock mechanism, the plate being tiltable in response to pressure from a drill bit applied substantially perpendicular to said wall to prevent the point of said drill bit from purchasing said plate, the plate being tiltable such that at least a part of the plate outer surface is at an angle of at least 31° from the plane of the adjacent wall.

* * * * *